United States Patent [19]

Ogden

[11] 4,374,587

[45] Feb. 22, 1983

[54] EXERCISE TREADMILL

[76] Inventor: Ralph Ogden, 1304 Fisher St., Munster, Ind. 46321

[21] Appl. No.: 226,766

[22] Filed: Jan. 21, 1981

Related U.S. Application Data

[63] Continuation-in-part of Ser. No. 175,516, Aug. 5, 1980, Pat. No. 4,344,616.

[51] Int. Cl.[3] ..... A63B 23/06

[52] U.S. Cl. ..... 272/69; 272/DIG. 4

[58] Field of Search ..... 272/69, 144, 145, DIG. 4; D21/192

[56] References Cited

U.S. PATENT DOCUMENTS

| | | | |
|---|---|---|---|
| D. 211,801 | 7/1968 | Quinton | D21/192 |
| 759,296 | 5/1904 | Moriarty | 272/69 |
| 1,824,406 | 9/1931 | Petersime | 272/69 X |
| 3,643,943 | 2/1972 | Erwin, Jr. et al. | 272/69 |
| 3,659,845 | 5/1972 | Quinton | 272/69 |
| 3,711,812 | 1/1973 | Cherry | 272/69 X |
| 3,737,163 | 6/1973 | Sumrall | 272/69 |

FOREIGN PATENT DOCUMENTS

| | | | |
|---|---|---|---|
| 1565616 | 3/1969 | France | 272/69 |
| 1565617 | 3/1969 | France | 272/69 |
| 221620 | 8/1942 | Switzerland | 272/69 |

*Primary Examiner*—Richard C. Pinkham
*Assistant Examiner*—Arnold W. Kramer
*Attorney, Agent, or Firm*—McWilliams, Mann & Zummer

[57] ABSTRACT

A treadmill exercising apparatus comprising a generally planar frame equipped with a planar slider bed and head and tail rollers journalled respectively at the head and tail ends of the frame. The rollers are provided with elastomeric material crowns, over which rollers an endless nylon belt is trained. The frame at its head end is equipped with a cross member in which are threadedly mounted in spaced apart relation a pair of threaded screw members that adjustably support the head end of the frame, with each of said screw members being journalled in its own foot for rotational movement with respect thereto, and with the threaded screw members being coupled together adjacent their upper ends for simultaneous manual operation in the same direction in forward and reverse directions. The screw members shift from an angled position to a substantially vertical position, in firm supporting relation to the treadmill frame, when operated to shift the treadmill frame from horizontal position to the maximum grade effect position. An electric drive motor assembly pivotally mounted on the cross member is spring biased to tension the drive belt stretching between step up and step down pulleys on the head roller and drive motor. A handle on the assembly is used to overcome the spring bias to free the belt for movement between pulleys to change the drive ratio.

12 Claims, 12 Drawing Figures

EXERCISE TREADMILL

This application is a continuation-in-part of my application Ser. No. 175,516, filed Aug. 5, 1980, and now U.S. Pat. No. 4,344,616.

This invention relates to an exercise treadmill, and more particularly to an exercise treadmill of the endless belt type.

Various forms and types of treadmill assemblies are available for exercise purposes involving endless belts. However, most commercially available equipment of this type is unduly expensive to be practical for individuals to have for home use, due to the tendency to incorporate sophisticated monitoring equipment and overdesign the basic apparatus to insure continuous exercise for individuals weighing up to two hundred fifty pounds or more and yet permit adjustment in slope and speed for making available to the user mild to exhaustive exercise for testing or conditioning purposes.

A principal object of the present invention is to provide a walking exercise treadmill of few and simple parts that avoids costly sophisticated instrumentation and other equipment not essential to exercise use as such, while providing the user with ready infinitely variable slope adjustment between zero and a predetermined maximum, such as twenty-five percent, and a suitable selection of belt speed adjustments.

Another principal object of the present invention is to provide an exercise treadmill that essentially comprises a slider bed type, endless belt trained, frame assembly providing for manually operable stepless slope selectability between zero and a predetermined maximum slope, with the frame support being arranged to automatically increase stability as the slope is increased to the maximum provided for.

Another important object of the invention is to provide an exercise treadmill that has minimal space requirements for storage and use, that has nominal maintenance requirements, and that is long lived and effective in use.

In accordance with the invention, an exercise treadmill is provided comprising a generally planar frame providing a slider bed, and head and tail rollers at the corresponding ends of the slider bed, over which is trained an endless belt that may be formed from nylon or the like, the upper run of which rides on a lubrication free canvas facing of the slider bed. The treadmill frame adjacent to and spaced forwardly of its head end is provided with a cross member in which slope adjusting devices are provided comprising a pair of spaced apart screw members that are threadedly mounted for supporting and changing the elevation of the frame head end to provide the slope, if any, desired. Each screw member is individually journalled in its own supporting foot that is arranged for rocking relation of the screw members with respect to the treadmill supporting surface for the treadmill feet, and the screw members are mounted for rotation about upright axes that are at like acute angles with respect to the plane of the slider bed, which axes angle forwardly of the treadmill upwardly of the slider bed frame. The indicated acute angulation of the screw member axes equal the maximum angulation the slider bed frame is to have at its maximum slope to be provided for, which is twenty-five percent in a preferred embodiment of the invention. The upper ends of the screw members are coupled together by a manually operated drive chain arrangement for adjusting the elevation of the treadmill head end to provide the slope desired up to the indicated maximum slope. The chain drive is protected by a cover that journals the upper ends of the respective screw members for maintaining the upper ends of same in coplanar relation with the frame cross member and in parallelism for effective simultaneous rotating action. The tail end of the treadmill frame is equipped with a pair of spaced feet, and the treadmill feet at both ends of the frame are proportioned so that the treadmill slider bed and cooperating endless belt are horizontally disposed when the screw members are in their retracted positions, with the slider bed and cooperating belt being angled upwardly at the predetermined maximum slope to be provided by the treadmill unit when the screw members are in their extended, substantially vertical relations.

The belt is power driven by a suitable electric motor carried by the treadmill frame cross member with stepped pulleys being provided for stepping down of the drive RPM and belt speed adjustment to provide belt movement at several selected speeds, such as 2.5, 3, and 3.5 miles per hour for walking exercise. The treadmill assembly or unit is equipped on either side of same with a hand hold railing of inverted U shaped configuration of which the bight of the railing is positioned for grasping as needed by the user.

Hand crank operation of the screw members from their retracted relations to their extended positions both swings the screw members to a substantial vertical supporting position without changing their angular relationship relative to the treadmill slider bed, and angles the treadmill slider bed and endless belt trained thereover at the desired maximum slope provided for, which is at the same acute angle relative to the horizontal that the screw member axes are angled relative to the plane of the treadmill slider bed.

The screw members of the slope adjusting devices are threadedly mounted in the treadmill frame cross member by way of a pair of special nut assemblies associated therewith, each of which includes a tubular member of square section through which the screw member associated therewith passes, and first and second nut members respectively keyed to the lower and upper ends of the tubular frame which threadedly engage the screw member thereof. The nut members are formed from nylon and the screw members are formed from steel, with the threading thereof being roll formed. The upper nut member of each of the nut assemblies is mounted for lost motion movement relative to the nut assembly tubular member to accommodate tolerance variations in the screw member threading.

The belt drive assembly includes a motor mounting assembly arrangement that is spring biased to applying an essentially constant tension in the drive transmitting pulley belt involved, which is freed from overstressing, with the motor mounting assembly arrangement including a hand crank arrangement for manually overcoming such biasing means and freeing the pulley belt for ready changing of treadmill driving speeds.

Still other objects, uses and advantages will become obvious or apparent from a consideration of the following detailed description and the application drawings in which like reference numerals indicate like parts throughout the several views.

However, it is to be understood that the specific drawing illustrations provided are supplied primarily to comply with the requirements of the Patent Laws, and that the invention is susceptible of modifications and variations that will be obvious to those skilled in the art, and which are intended to be covered by the appended claims.

Figure 1:
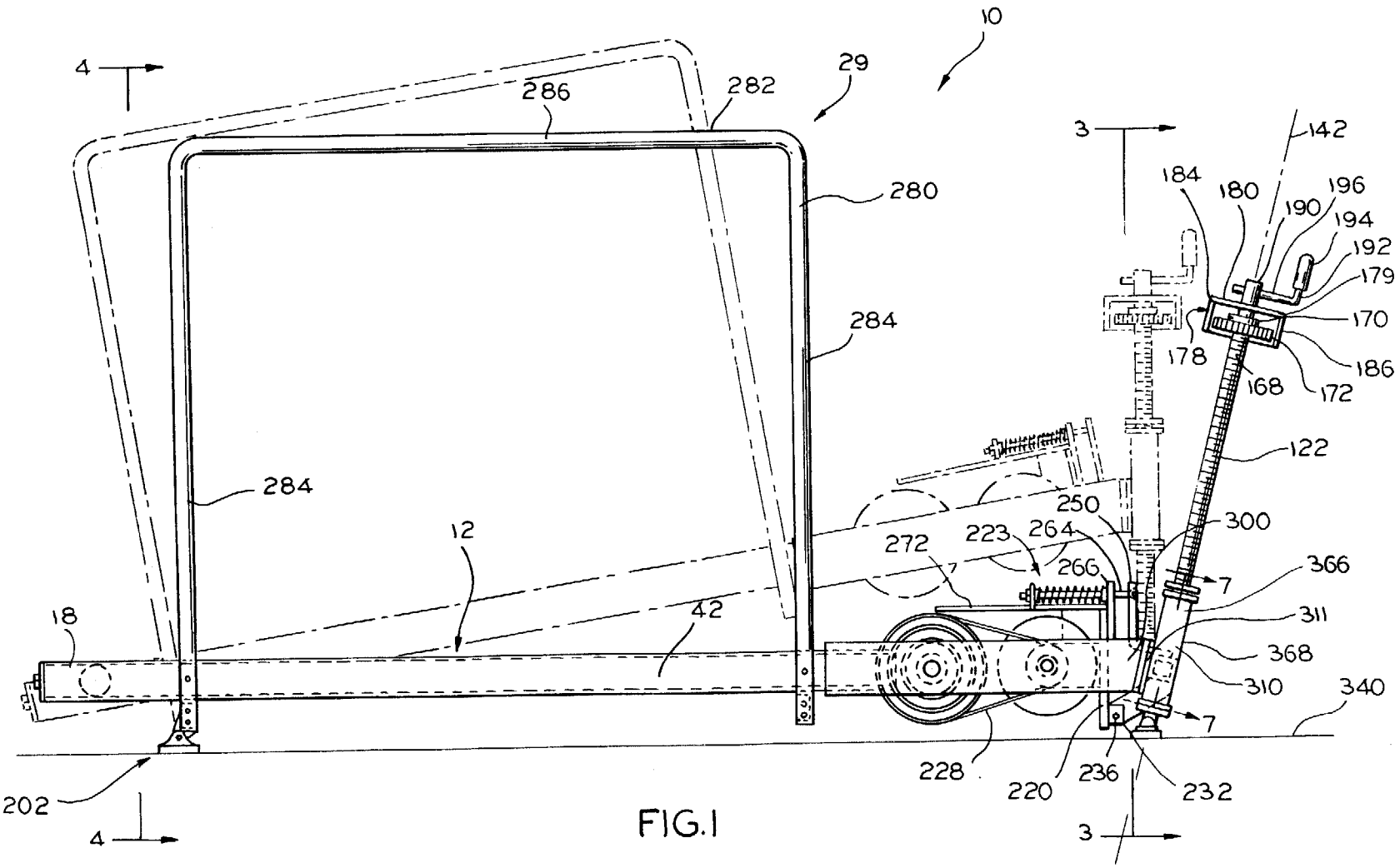
FIG. 1 is a side elevational view diagrammatically illustrating the preferred embodiment of the invention, showing the treadmill assembly in full lines at its zero slope position, and in phantom in its maximum slope position of the Illustrated embodiment, which is 15 degrees relative to the horizontal or a twenty-five percent grade.
Figure 2:
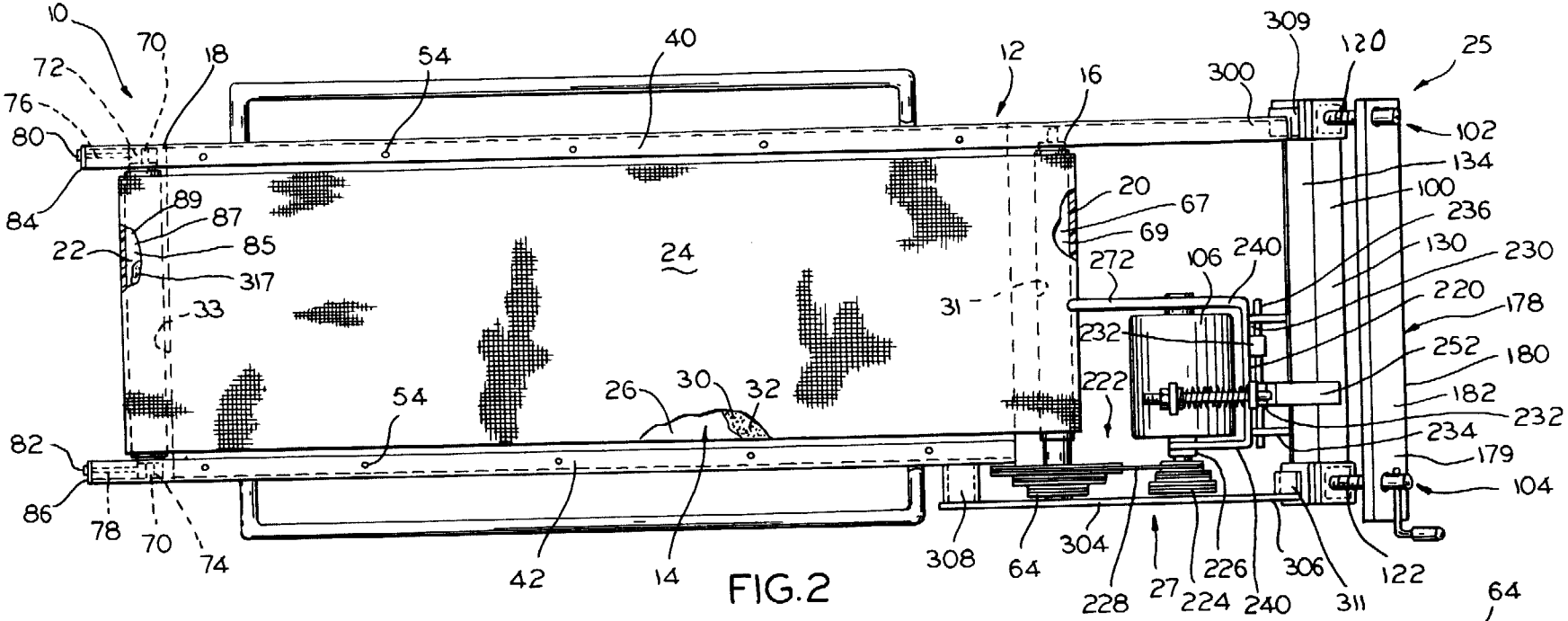
FIG. 2 is a top plan view of the treadmill assembly as shown in its full line position of FIG. 1, with parts broken away.
Figure 9:
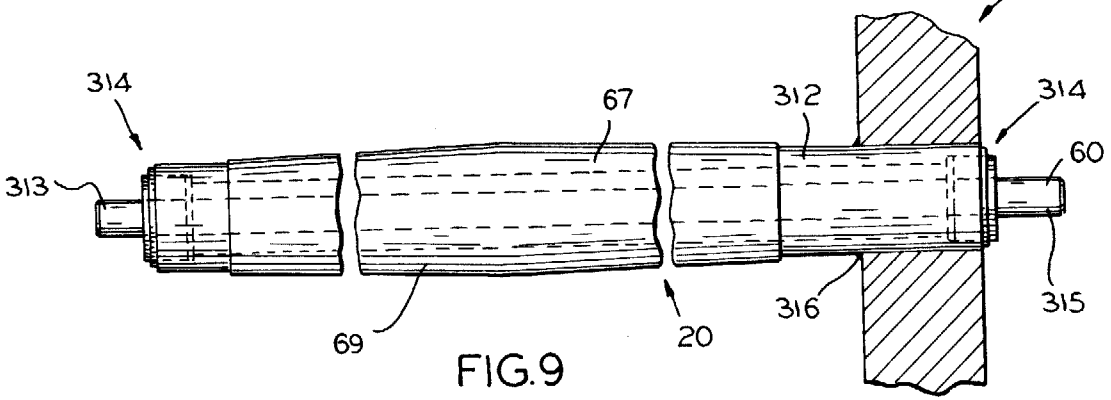
FIG. 9 is a fragmental plan view of the treadmill head roller and its associated drive pulley, with parts broken away.

Reference numeral 10 of FIGS. 1 and 2 generally indicates a diagrammatically illustrated embodiment of the invention that follows the basic arrangement disclosed in my said application Ser. No. 175,516, filed Aug. 5, 1980, and now U.S. Pat. No. 4,344,616 (the disclosure of which is incorporated hereby by this reference, and more specifically the preferred embodiment of FIGS. 8–11 thereof). For completeness of disclosure, the general arrangement of the apparatus 10 is repeated herein in conjunction with the improvements of the present invention.

The treadmill apparatus or unit 10 generally comprises a flat or planar frame 12 including a slider bed 14 extending between the head end 16 of the frame and the tail end 18 of the frame, head roller 20 that is journalled at the head or front end 16 of the frame, tail roller 22 that is journalled at the tail or back end 18 of the frame, and endless belt 24 that is trained over the slider bed 14 and the head and tail rollers 20 and 22. The frame 12 is equipped forwardly of head roller 20 with a slope adjusting device 25, whereby the user may manually adjust the slope of the treadmill between the two positions indicated in FIG. 1, and belt drive apparatus 27 that is carried by frame 12. Frame 12 also is equipped with side mounted holds 29 (see FIGS. 1 and 4).

The slider bed 14 comprises a flat or planar sheet of plywood or the like 26 of rectangular outline and proportioned to extend substantially between the locations of the head roller 20 and the tail roller 22, with the slider bed ends being indicated in FIG. 2 at 31 and 33. The slider bed 14 has an upwardly facing fabric surfacing 30 provided by a sheet 32 of cotton duck canvas or the like suitably affixed to sheet 26 (by bonding or the like). The canvas should be dry and free of any lubricant materials of either the wet or dry types.

The belt 24 is preferably formed from nylon, Delrin, or the like. The belt 24 may also be formed from the molybdenum disulphide filled nylon product sold under the brand name Nylatron GS by the Polymer Corporation of Reading, Penn. It has been found, as disclosed in my application Ser. No. 175,516 that using the nylon belt in combination with the canvas slider bed surfacing 30 and free of any dry or wet lubricant surprisingly provides a support for the belt upper run that has better antifriction characteristics than if the canvas were impregnated with such substances as wax or graphite. A coefficient of friction on the order of 0.14 is readily provided by the Applicant's nylon belt-dry canvased slider bed surfacing arrangement. This is a significant factor in minimizing drive power requirements and bearing stresses of rollers 20 and 22.

The frame 12 further comprises a pair of opposed channel members 40 and 42 each of which comprises web portion 44 and spaced flanges 46 and 48. The slider bed 14 is formed to define longitudinally extending side edges 50 and 52 over which and against the respective frame members 40 and 42 are applied, with suitable bolts or screws 54 anchoring the slider board 14 (as equipped with the surfacing 30, to the frame members 40 and 42 at spaced points along the treadmill frame. Frame 12 as shown is in the preferred form of FIGS. 8–11 of my said application, and thus the end 300 of frame member 40 extends forwardly of the apparatus for association with slope adjusting device 25, and frame member 42 is equipped with mounting plate 304 for the same purpose, plate 304 being suitably secured to frame member 42 by employing a fabricated connecting block 308 that is welded or otherwise secured to both plate 304 and channel member 42 at its web portion 44.

The head roller 20 comprises (see FIG. 9) roller shell 312 journalled on shaft 60 by suitable ball bearing units 314 at either end of same. Shaft 60 is suitably secured in channel member 40 at one of its ends 313 and the plate 304 at its other end 315, with suitable step drive pulley 64 being received over one end of the shell 312 and welded thereto as indicated at 316.

Roller shell 312, which is conveniently formed from steel or the like, is provided with a crown 67 formed from a suitable elastomer molded in place on shell 312, for belt centering purposes and provides for increased coefficient of friction of the roller surfacing 69 that engages the belt 24. Crown 67 has a length that approximates the width of belt 24 and defines crowned surfacing 69 of a shaping suitable for belt centering purposes.

The tail roller 22 may be arranged in the same manner as the head roller 20, except its shaft 70 has its ends journalled in the respective suitable bearings 72 and 74 that are threadedly connected to the respective bolts 76 and 78 having their respective heads 80 and 82 seated against the respective abutment plates 84 and 86 suitably affixed to the ends of the frame members 40 and 42 at the tail end 18 of the frame 12, to provide for movement of the tail roller 22 relative to the head roller 20 to tension the belt 24 as desired. Tail roller 22 thus includes a shell 317 that is similar to shell 312 of head roller 20, but suitably proportioned in diameter for tail roller use, to which is applied the crown 85 that forms crown surfacing 87 (which are thus similar to the crown 67 and surfacing 69 of the head roller 20, but suitably proportioned for tail pulley use). The mounting of the ends of the shell 317 on shaft 70 is the same indicated in FIG. 9 except that the drive pulley is omitted, of course, and crown 85 is centered along the length of tail pulley 22 and its shell 317.

A critical aspect of the invention is applicant's discovery that, as disclosed in applicant's said application, the loads on the bearings in which the driving head roller 20 is journalled may be minimized when using nylon or the like belting, by crowning such roller 20 with a suitable elastomer, while retaining the basic metallic roller structure for strength and rigidity. Applicant's invention contemplates that to achieve desirable minimumization of the loads on the bearings in which driving roller 20 is journalled, the static coefficient of friction of the elastomeric crowning material to nylon should be a minimum of 0.3. Tests have shown that, for instance, nitrile rubber (50 durometer) relative to nylon has static and dynamic coefficients of friction of about 1.36 and 1.25, respectively, neoprene (65 durometer) has corresponding coefficients of friction of about 1.31 and 0.627, respectively, SBR butadiene (65 durometer) has corresponding coefficients of friction of about 0.89 and 0.58, respectively, and gum rubber (35 durometer) has corresponding coefficients of friction of 0.37 and 0.35, respectively; these and other equivalent elastomers thus provide at least the indicated minimum coefficient of static friction and satisfy the invention requirements for use as the roller crowning. The result is that the frame 12 and the bearings for driving roller 20 may be greatly simplified and of inexpensive design by reason of the substantial minimumization of the bearing stress requirements. The nitrile rubber is preferred since it has a relatively high coefficient of dynamic friction as a back up should belt slippage occur.

As to tail roller 22, as it is not a driving roller, but rather is an idler, it may be an ordinary steel roller, journalled in bearings 72 and 74. The advantages of the elastomeric crowning for roller 20 are of benefit only for driving rollers.

Frame 12 at its head end 16 includes a pair of slope adjusting support devices 102 and 104. The drive motor 106 (and associated parts) for driving belt 24 comprising drive apparatus 27 are also mounted at the frame head end 16.

The general arrangement of the cross member 100 and its slope adjusting support devices 102 and 104 is of special significance. As indicated in FIG. 1, it is a feature of the invention that for zero slope conditions, the slope adjusting devices 102 and 104 are to be in their retracted positions, but when the treadmill is elevated to its maximum design height, the devices 102 and 104 are to be in their extended positions relative to the frame 12 for slope defining purposes. It is apparent that for the treadmill 10, when in its maximum slope defining position, its stability needs for the head end of the frame 12 are maximum, while in its zero slope defining position (the full line position of FIG. 1), its stability needs are minimal.

The invention contemplates that the treadmill assembly 10 will provide for a repositioning of the slope adjusting devices 102 and 104, which incidentally are the only means of support of the treadmill 10 at its forward end, so as to improve the stability they provide, as the treadmill position of maximum slope is approached and reached, in accordance with the increasing need for stabilization as the frame head end elevates. For this purpose, the Applicant's arrangement contemplates that the slope adjusting devices 102 and 104 will be disposed to operate about upright axes that are at an acute angle off perpendicular or normal relation with the plane of the slider bed 14, which acute angle is equal to the acute angle of the slider bed 14 relative to the horizontal that will provide the maximum slope of operation of the treadmill 10. Further, the slope adjusting devices 102 and 104 are to be of sufficient length to elevationally move cross member 100, and thus the treadmill frame 12 to the indicated slope maximum, while at the same time shifting the slope adjusting devices 102 and 104 from the forwardly angled relation, upwardly of the treadmill, that is illustrated in the full line showing of FIG. 1, to the substantially vertical relation that is illustrated in the phantom line position of FIG. 1, which disposes the slope adjusting members 102 and 104 for maximum bracing relation relative to the frame 12.

Figure 8:
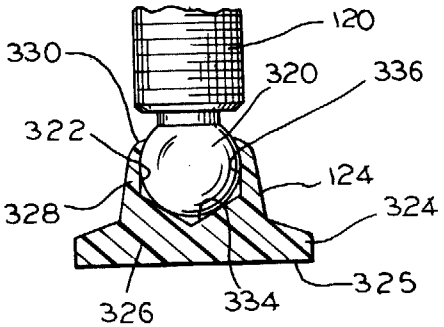
FIG. 8 is a fragmental sectional view of the lower end of one of the treadmill slider bed supporting screw members, illustrating its supporting foot and the manner in which the screw member is journalled in same.
Figure 3:
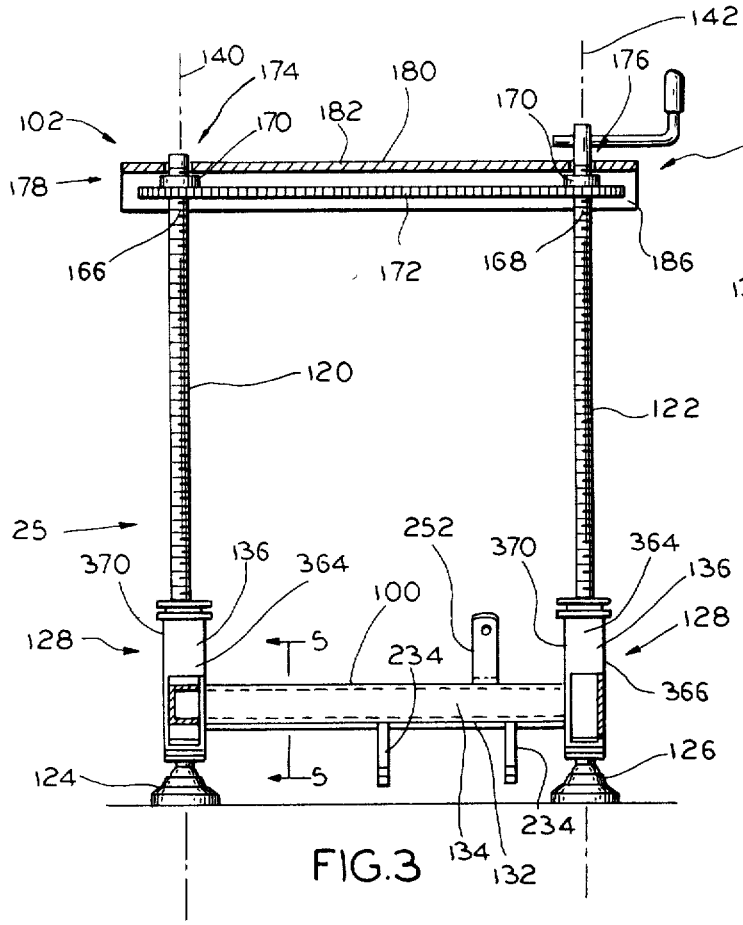
FIG. 3 is a vertical sectional view taken substantially along line 3—3 of FIG. 1, but with the operating motor assembly omitted to simplify the drawing.

In the specific arrangement illustrated, this aspect of the invention is provided by way of slope adjusting devices 102 and 104 each comprising the respective screw or threaded members 120 and 122 that are respectively equipped with the respective feet 124 and 126 in the manner diagrammatically illustrated in FIG. 8 for the foot 124. The threaded members 120 and 122 are each respectively threadedly mounted in cross member 100 by a stationary nut assembly 128 that is more particularly illustrated in FIGS. 7 and 11, and which will be described in detail hereinafter.

Figure 5:
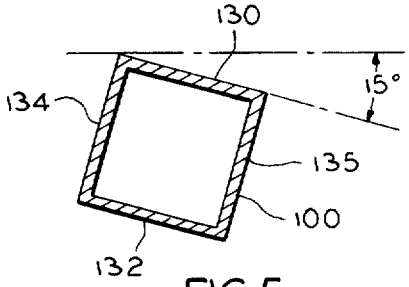
FIG. 5 is a fragmental sectional view taken along line 5—5 of FIG. 3, on an enlarged scale.
Figure 6:
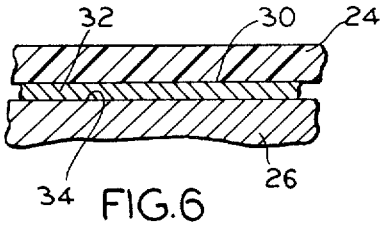
FIG. 6 is a fragmental view on an enlarged scale illustrating a sectional view through the slider bed and showing the canvas sheeting that forms the slider bed top surfacing across which the upper run of the belt rides.

In the specific form illustrated, cross member 100 is of quadrilateral tubular transverse cross-sectional configuration (approximately square in the illustrated embodiment, see FIG. 5) and defines top wall 130, bottom wall 132, rear wall 134 and forward wall 135, as illustrated in FIG. 5.

The nut assemblies 128 each comprise in the illustrated form a tubular member or shell or sleeve 136 of quadrilateral transverse cross-sectional configuration (square in the illustrated embodiment) with shells 136 suitably fixed to either end of the cross member 100, as by employing welding, so as to be an integral part of the cross member 100. Each shell 136 has applied to either end of same nut elements 138 and 138A that are formed, for instance, from nylon or the aforementioned Nylatron GS products, and keyed to the sleeve 136 in the manner described in detail hereinafter, and that are suitably internally threaded and oriented to complement the threading of the respective threaded members 120 and 122 for threaded relation thereto. Suitable roll formed threading of any suitable type may be employed for this purpose, as will be hereinafter made clear.

The sleeves 136 of nut assemblies 128 are fixed (as by welding) to the cross member 100 (and thus are a part of same) so that the axes of rotational operation 140 and 142 of the respective devices 102 and 104 will be perpendicular to the top and bottom walls 130 and 132 of the cross member 100 and be centered between the side walls 134 and 135 of same (as indicated by the showing of FIG. 1). However, the cross member 100 and the nut devices 128 affixed thereto at either end of same are secured into the frame 12 in angled relation thereto, as is also indicated in the showing of FIG. 1 as well as FIG. 5. In this angled relationship, the cross member 100 and its associated nut devices 128 are oriented relative to the plane of the slider bed 14 and its frame 12 so that the top and bottom walls 130 and 132 of the cross member are angled at an acute angle relative to the plane of slider bed 14 and frame 12, with the result that the axes of rotational operation 140 and 142 of the respective slope adjusting devices 102 and 104 are angled at the same acute angle off the vertical when the frame 12 is horizontally disposed. In this position of the frame 12, the operational axes 140 and 142, in addition to lying in parallel vertical planes that extend longitudinally of the frame 12, also project forwardly of the unit 10 upwardly of the frame 12.

As has been indicated, the treadmill assembly 10 is arranged and proportioned to provide a maximum slope of twenty-five percent in its position of maximum inclination, which translates into an angulation of approximately 15 degrees relative to the horizontal, as indicated in FIG. 1. In accordance with the invention, the cross member 100 and its nut devices 128 are fixed to frame 12 to dispose its top and bottom walls 130 and 132 at an angle of approximately 15 degrees relative to the plane of the frame 12, and thus dispose the operating axes 140 and 142 of devices 102 and 104 at an angle of approximately 15 degrees off the vertical when the frame 12 is in its horizontal relation shown in FIG. 1.

In the treadmill apparatus 10, the projecting end 300 of the channel member 40 and the forwardly extending end 306 of the plate 304 have the respective mounting plate structures 309 and 311 affixed thereto and are angled with respect to the plane of the frame 12 at an angle of 75 degrees to achieve the aforementioned angulation of the cross member 100 relative to the horizontal, by the respective mounting plate structures 309 and 311 being suitably affixed to the respective shells 136, as by employing welding, screw type fasteners, or the like. The frame 12 thus defines a downwardly angled forward end portion 310 that lies in a plane that is at an angle of 75 degrees relative to the plane of the basic frame 12, as indicated in FIG. 1. Cross member 100 in treadmill 10 thus is joined in the frame 14 to have its top and bottom walls 130 and 132 perpendicular to the plane of the frame portion 310, but at the indicated angle of 15 degrees relative to the plane of the basic frame 12, as indicated in FIG. 1, in which cross member 100 lies. When frame 12 is at the zero slope position, slope adjusting devices 102 and 104 are disposed at a fifteen degree angulation off the vertical.

As has also been indicated, the respective screw members 120 and 122 are journalled in their respective feet 124 and 126, which are diagrammatically illustrated in FIG. 8 in the specific showing of foot 124. Thus, the threaded members 120 and 122 at their lower ends are formed with a ball terminal portion 320 which is received in the socket 322 of foot 124 that is formed from a suitable plastic material such as nylon or the like. The foot 124 defines a planar sole portion 325 that forms one side of disc portion 326, with the socket 322 being defined by an annular wall structure 328 projecting from the disc portion 326 that tapers upwardly of the disc portion 326 into a resiliently flexible continuous lip 330 which is proportioned such that the ball terminal portion 320 may be snap fitted into the socket 322 for permanent retention of the foot 124 on the ball 320. The foot 124 defines the internal conical surface 334 against which the ball portion 320 rockably and rotatably engages, and upstanding annular wall surface 336 that confines the ball 320 centrally of the foot 124.

Thus, the slope adjusting support devices 102 and 104 as equipped with the feet 124 and 126 are rotatably and rockably mounted within the respective feet 124 and 126 which in turn have their undersurfaces 234 in flush engagement with the apparatus supporting surface 340.

The threaded members 120 and 122 at their respective upper ends 166 and 168 are each equipped with a chain drive sprocket 170 over which endless drive chain 172 is trained. The upper ends 166 and 168 of the respective threaded members 120 and 122 are also suitably journalled, as indicated at 174 and 176, in chain drive cover 178.

The cover 178 as illustrated comprises a shield 179 in the form of channel shaped member 180 having web portion 182 in which the upper ends 166 and 168 of the respective threaded members 120 and 122 are journalled, and depending side flanges 184 and 186 which extend downwardly sufficiently from the web portion to overlie and mask drive chain 172. In the form shown, the channel member 180 is of sufficient length to cover both ends of the drive chain 172 as it is disposed in trained relation over the sprockets 170, but if so desired, the cover 178 could be provided with rounded end portions that join the cover flanges 184 and 186 at either end of the cover 178.

The upper end 168 of the threaded member 122 is extended where indicated at 190 and has removably applied to same crank handle 192 comprising hand gripping portion 194 at right angles to stem portion 196 which in turn is suitably removably received in a bore formed in the end portion 190 in close fitting, radial relation thereto.

It will thus be observed that by rotating operating handle 192 about the operating axis 142 of the threaded member 122, both the devices 102 and 104 will be simultaneously operated about their respective operational axes 140 and 142 by way of the coupling provided by drive chain 172 and the cooperating sprockets 170. Thus, the threaded members 120 and 122 may be turned in one direction about their respective axes 140 and 142 to shift the frame 12 from its horizontally disposed position of FIG. 1, in which the devices 102 and 104 are in their retracted relations, to the maximum slope position shown in the phantom line position of FIG. 1, in which the devices 102 and 104 are in their extended relations. As already indicated, the threaded members 120 and 122, in moving from the full line position of FIG. 1 to the phantom line position thereof, rock rearwardly of the treadmill from the upwardly angled relation shown in the full line position of FIG. 1 to the substantially vertical relation shown in the phantom line position of FIG. 1.

Rotation of the threaded members 120 and 122 in the opposite direction returns the treadmill to the full line position of FIG. 1, whereby the devices 102 and 104 are returned from their extended relations to their retracted relations. Regardless of which direction the members 120 and 122 are operated, their threaded connections with the frame cross member 100 through nut devices 128 move the cross member 100 longitudinally of the respective members 120 and 122 to achieve the changes of slope of the treadmill 10 as may be desired.

The frame 12 at its rear end 18 is equipped with a pair of leg structures 200 and 202. In the form diagramatically illustrated, frame 12 has cross channel member 201 affixed to the underside of same, as by employing suitable fasteners 203 applied to the respective frame members 40 and 42, and having end plates 204 affixed to either end thereof, to each of which is respectively pivotally connected the respective feet 205 and 206, as by employing suitable pins 207. Feet 205 and 206 have flat floor engaging surfaces 208, with frame 12 pivoting with respect thereto in being moved between the positions indicated in FIG. 1, and formed from nylon or the like. The foot structures 200 and 202 and the feet 124 and 126 of the respective devices 102 and 104 are proportioned such that when the treadmill assembly 10 rests on horizontal supporting surface 340 (that is intended to represent a floor or the like), and the slope adjusting devices 102 and 104 are in their retracted relations, the frame 12 and its slider bed 14 will be horizontally disposed.

The drive motor 106 comprises any suitable electrically driven motor arranged in a suitable manner for connection to an appropriate source of electrical energy (not shown). The motor 106 is mounted in support frame 220 that is pivotally connected to cross member 100 to permit tensioning of step drive assembly 222 by tensioning device 223, and manual release of same for adjustment purposes, as will be described.

The step drive assembly 222 comprises suitable stepping pulley 224 mounted on and keyed to motor shaft 226 in proper coplanar alignment with stepping pulley 64 that is keyed to shaft 60, with pulley belt 228 being optionally applied to the sets of coplanar related pulley grooves of the pulleys 64 and 224 such that the belt 24 will be driven at one of the speeds indicated, namely 2.5, 3, or 3.5 miles per hour, at the user's option. These speeds are suitable for walking exercise purposes. As slider bed surfacing 32 has a coefficient of friction of about 0.14 relative to a belt 24 formed from nylon, and the elastomeric crowning of the head and tail rollers maximizes the coefficient of friction between the belt 24 and rollers 20 and 22, a one-third horsepower motor will satisfy the power requirements for a two hundred pound individual using treadmill 10, for example.

The motor support frame 220 comprises web portion 230 fixedly equipped with a pair of lugs 232 that are respectively journalled between the set of lugs 234 that are suitably affixed to the side wall 134 of the cross member 100, as by employing suitable pin 236. The motor support 220 also includes spaced side flanges 240 embracing motor 106 between which the motor 106 is suitably mounted.

Figures 10, 11, 12:
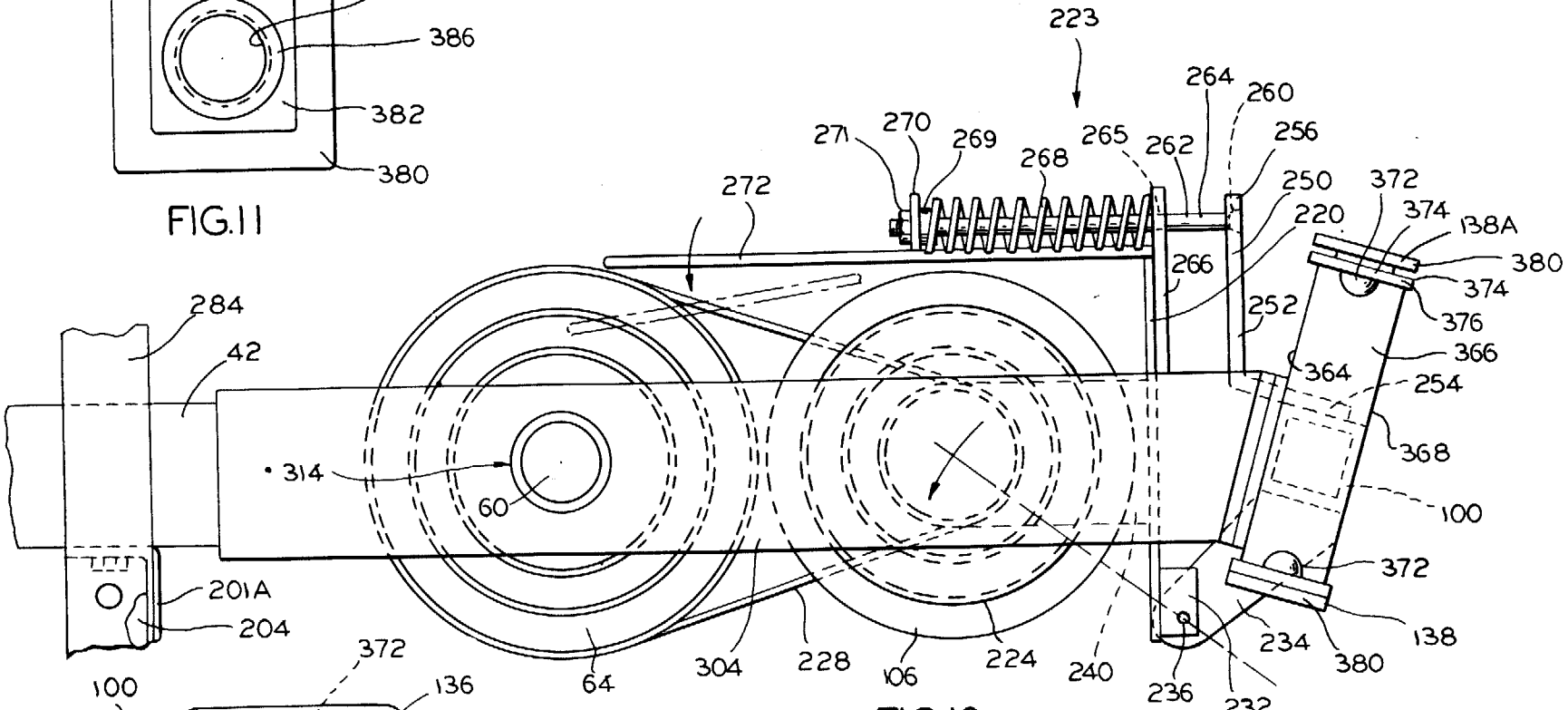
FIG. 10 is a fragmental side elevational view of the head end of the slider bed frame and the drive motor assembly associated therewith, on an enlarged scale, and diagrammatically illustrating the spring biased pulley belt tensioning arrangement and manual release therefor that forms a part of the invention.
FIG. 11 is a plan view of one of the nut members involved in the nut assembly of this invention.
FIG. 12 is a top plan view of one of the nut assembly mounting sleeves, with the nut element omitted.

Affixed to the cross member 100 is an upright post 250 in the form of bar 252 that has its lower end 254 affixed to the top wall 130 of the cross member 100, as by employing welding. The bar 252 defines upstanding end portion 256 which is formed with aperture 260 through which extends the threaded shank 262 of screw member 264 which extends through aperture 265 formed in upstanding bar 266 that is fixed, as by welding to web portion 230 of the motor carrier 220. Screw member 264 extends through compression spring 268, spring seat 269, and washer 270 for threadedly receiving adjusting nut 271. Nut 271 is positioned on screw member 264 to compress spring 268 between bar 266 and washer 270 so as to provide tensioning device 223 to give belt 228 the desired tension. This arrangement provides that belt 228 will operate under constant tension and will not be overstressed, as load surges are absorbed by spring 268. Support frame 220 has suitable handle 272 fixed to same extending rearwardly of the treadmill, as by being welded to the lug 234 of frame 220 in overlying relation thereto, so that the user of the treadmill, if he desires to change the driving speed of belt 24, may depress handle 272 downwardly, as indicated in FIG. 10, to compress spring 268 and fully relieve the tension in pulley belt 228 for ease of changing its position relative to pulleys 64 and 224, with one hand while holding handle 272 depressed with his other hand. On effecting the desired repositioning of pulley belt 228, handle 272 is released for application of tension thereto by device 223. Nut 271 may be adjusted as needed, relative to screw member 264 to apply the desired amount of tension to belt 228. The location of the pivot axis for frame 220 is disposed well below the plane of frame 12, and the common plane of the axes of rotation of motor shaft 226 and head roller shaft 60, to provide the belt crank action needed for this functioning of parts (see FIG. 10).

Figure 4:
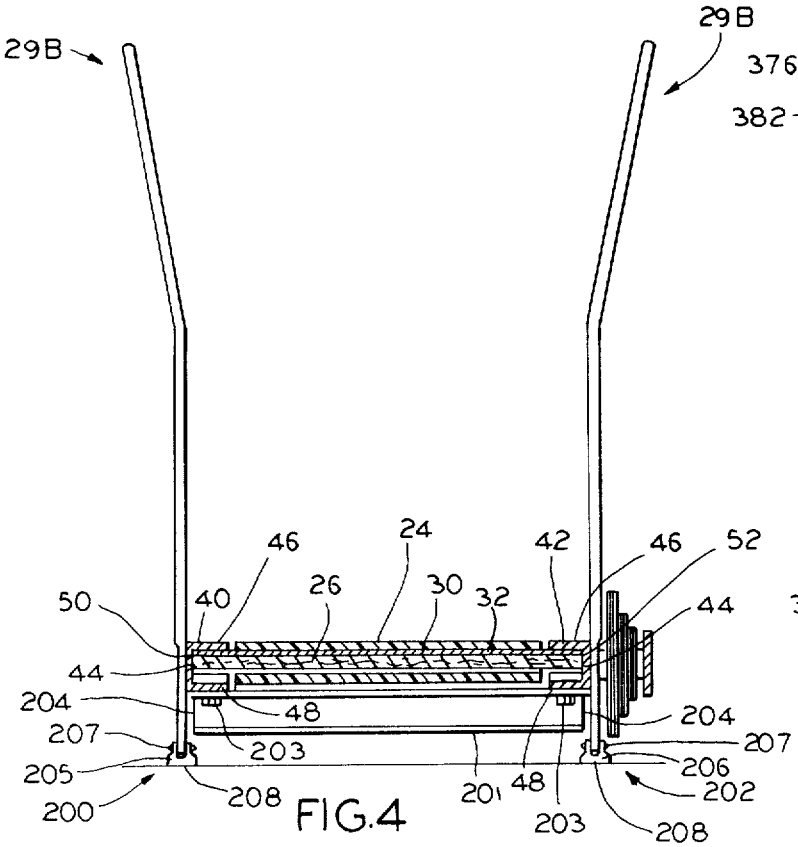
FIG. 4 is a vertical cross-sectional view taken substantially along line 4—4 of FIG. 1, illustrating the general arrangement of the slider bed and belt that is trained over same, and the slider bed hand holds on either side of same.

The hand holds 29 of treadmill 10 each comprise a fixed side railing 280 that is in the form of brace member 282 suitably shaped from rod or pipe stock to define upright legs 284 and rectilinear bight or hand hold portion 286. The rear legs 284 of each railing 280 are anchored to the respective plates 204 of the frame channel member 201 that mounts feet 205 and 206, while the forward legs 284 are anchored to similar plates 204 of a similar channel member 201A affixed to the underside of frame 12 in the same manner, using suitable screw fasteners or the like for this purpose. This disposes hand rails 280 in upright inverted U relation extending longitudinally of frame 12. Legs 284 are proportioned in length and outwardly angled as indicated in FIG. 4 so that the user when mounting and working out on the treadmill apparatus may grasp the hand rail 280 as needed to steady himself.

Figure 7:
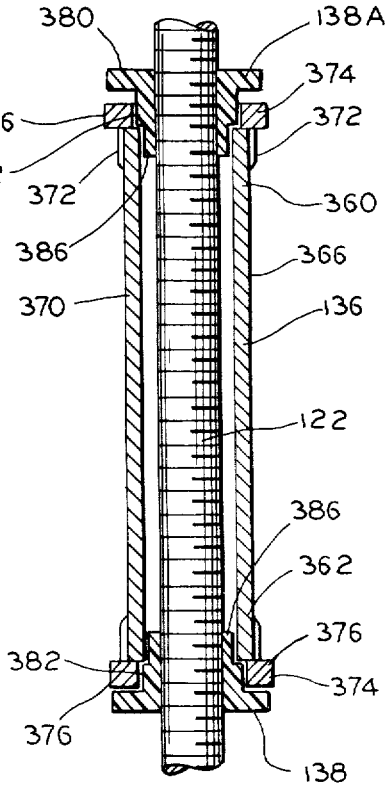
FIG. 7 is a diagrammatic fragmental view taken along line 7—7 of FIG. 1, on an enlarged scale, illustrating the novel nut assembly arrangement that forms a part of the illustrated embodiment.

Referring now more specifically to FIGS. 7, 11 and 12, the sleeves 136 of nut assemblies 128 at their upper and lower ends 360 and 362 are outwardly indented at the midportion of their respective sides 364, 366, 368, and 370, where indicated at 372 to freely accommodate the respective nut elements, which are identical, nut 138A being shown in detail in FIG. 11. The sleeves at their respective ends 360 and 362 have fixed to same, as by welding, an open centered plate 374 that is shown in plan in FIG. 12, that form the respective end flanges 376 of sleeves 136 at either end of same. The nut elements 138 and 138A each define quadrilateral flange portion 380 that has marginal dimensioning comparable to the outer marginal dimensioning of plates 374, a quadrilateral stud portion 382 shaped to be substantially complemental to the quadrilaterally contoured open center 384 of plates 374, and a cylindrical stud portion 386 proportioned to fit within the sleeve ends 360 and 362 and that is internally threaded as at 388 for threaded engagement with the respective threaded members 122 and 124.

The nut assemblies 128 are assembled as indicated in FIG. 7, without having to fix or bond nut elements 138 and 138A to the respective sleeves 136. For this purpose, the threaded members 120 and 122 are threaded through the nuts 138 and 138A of a particular assembly 128, with the parts thereof oriented as suggested in FIGS. 1, 3, 7 and 10, with the result that cross member 100 rests on the lower nut elements 138 through its sleeves 136, and the nuts 138A are free to float longitudinally of the respective threaded member, axes 140 and 142, with respect to their sleeves 136, to accommodate tolerance variations in the formation of the threading of the steel members 120 and 122, as well as the differences in the coefficients of thermal expansion of the nut elements and steel. The nut elements 138A thus normally may have their flange portions 380 spaced somewhat from the sleeve upper end flanges 376, in accommodating such variations, which permit the use of any suitable rolled threading in forming threaded members 120 and 122. The outward indentations 372 of sleeves shape same to freely receive the nut element stud portion 386. Nut elements 138 and 138A are preferably formed from a suitable self lubricating material, such as the aforeindicated nylon.

It will be apparent that in the apparatus 10, rotation of operating handle 192 about the axis 142 of threaded member 122 will simultaneously operate both the slope adjusting support devices 102 and 104 in the manner already described. Thus, the threaded members 120 and 122 of the apparatus 10 may be turned in one direction about the respective axes 140 and 142 to shift the frame 12 from its horizontally disposed full line position of FIG. 1, in which the devices 102 and 104 are in their retracted relations, to the maximum slope position shown in the phantom line showing of FIG. 1, in which the devices 102 and 104 are in their extended relations, and frame 12 is disposed at an approximate 15 degree angulation with respect to the horizontal, with its frame portion 310 substantially vertically disposed and the threaded members 120 and 122 of the respective devices 102 and 104 positioned substantially vertically, and having been rocked rearwardly of the treadmill from their upwardly angled relation shown in the full line position of FIG. 1.

Operation of the devices 102 and 104 in the opposite direction rotates the threaded member 120 and 122 thereof in the opposite direction to return the treadmill to its full line relation indicated in FIG. 1, whereby the devices 102 and 104 are returned from their extended relations to the retracted relations.

It will thus be seen that the treadmill assembly of the present invention provides a simplified, complication free exercise apparatus suitable for walking exercise at the pace and slope rate desired by the user. The slider bed and frame construction therefor are of minimal and simplified components arranged for ready securement together and rugged resistance to hard use. Jogging or trotting use may be provided for by providing a drive apparatus that will move the belt 24 at selected speeds of up to eight miles per hour.

The assembly 10 requires no instrumentation, and the adjustable simplified nature of the belt drive permits ease of manual adjustment for speed changes and off-on operation, and provides a constant and uniform tension on the drive pulley belt which is freed from overstressing possibilities. The simple canvas slider surface for the nylon belt slider bed provides coefficient of friction characteristics that are lower than of the canvas where coated or impregnated with wax, graphite, or the like, while also eliminating the messiness that can accompany the use of such materials. The elastomeric belt roller crowning increases the static coefficient of friction of the rollers relative to the belt to levels that insure minimal bearing stresses.

The supporting feet for the assembly 10 in the zero slope position of FIG. 1 are highly effective in maintaining stability in use, with the angulation of the threaded members 120 and 122 in the zero slope position of the apparatus being of no significant effect due to the disposition of the cross member 100 in close adjacency to the feet of devices 102 and 104. As the treadmill apparatus is elevated to its maximum slope position, the slope adjusting devices 102 and 104 shift toward and to the stabilizing and vertically disposed position indicated in the phantom showing of FIG. 1.

Operation of the slope adjusting devices 102 and 104 is easy and effective, with the threaded mounting of the threaded members 120 and 122 in the cross member 100 and the journalling of their upper ends in cover 178 maintaining the threaded members 120 and 122 in uniform spaced apart parallel relation for effective simultaneous operational movement about their respective axes 140 and 142.

The proportioning and simplified nature of the treadmill assembly 10 makes it practical for the individual user to use and store same in his home. Shifting of the assembly is easily done by picking up the head end of same and pushing or pulling as needed.

The foregoing description and the drawings are given merely to explain and illustrate the invention and the invention is not to be limited thereto, except insofar as the appended claims are so limited, since those skilled in the art who have the disclosure before them will be able to make modifications and variations therein without departing from the scope of the invention.

I claim:

1. In an exercise treadmill including a generally planar slider bed having a head end, a tail end, and a top surfacing extending substantially between said ends thereof, an endless belt trained over said slider bed defining an upper belt run overlying said slider bed top surfacing and a lower run passing under said slider bed, means for driving said belt for movement of said belt upper run from said head end to said tail end of said slider bed, said slider bed having secured to same adjacent said head end thereof a cross member extending transversely thereof, a pair of screw members threadedly mounted in said cross member in spaced apart relation and for rotation about upright axes that are in parallelism and that are inclined at like acute angles off perpendicular relationship relative to the plane of said slider bed, with each of said screw members having a foot journalled thereof, and means for simultaneously rotating said screw members in the same direction in forward and reverse directions for threading said cross member longitudinally of said screw members to raise and lower said slider bed head end, the improvement wherein:

said cross member includes a pair of nut assemblies, with one of the screw members being threadedly received in one of said nut assemblies and the other of the screw members being threadedly received in the other of said nut assemblies, said nut assemblies each comprising;

a tubular member of polygonal transverse cross-sectional configuration having a first nut member keyed to the lower end of same and a second nut member keyed to the upper end of same, with the screw member of each nut assembly being threadedly engaged by said nut members thereof, said second nut members being mounted relatively to its tubular member for lost motion longitudinally thereof.

2. The improvement set forth in claim 1 wherein:

said second nut members are formed from a non metallic self lubricating material.

3. The improvement set forth in claim 2 wherein:

said screw members each have threaded portions of substantially equal lengths, said threaded portions being defined by rolled threading.

4. The improvement set forth in claim 3 wherein:

said first nut members are formed from a non-metallic self lubricating material.

5. The improvement set forth in claim 1 wherein:

said feet of said screw members each has a planar sole.

6. In an exercise treadmill including a generally planar slider bed having a head end, a tail end, and a top surfacing extending substantially between said ends thereof, an endless belt trained over said slider bed defining an upper belt run overlying said slider bed top surfacing and a lower run passing under said slider bed, means for driving said belt for movement of said belt upper run from said head end to said tail end of said slider bed, said slider bed having secured to same adjacent said head end thereof a cross member extending transversely thereof, a pair of screw members threadedly mounted in said cross member in spaced apart relation and for rotation about upright axes that are in parallelism and that are inclined at like acute angles off perpendicular relationship relative to the plane of said slider bed, with each of said screw members having a supporting foot journalled thereof, and means for simultaneously rotating said screw members in the same direction in forward and reverse directions for threading said cross member longitudinally of said screw member threaded portions to raise and lower said slider bed head end, the improvement wherein:

said belt driving means comprises:

a head roller journalled in said slider bed adjacent the head end of same over which the belt is trained, said head roller being journalled for rotation about an axis paralleling said cross member, with the slider bed cross member being spaced from said head roller forwardly of said slider bed, an electric drive motor assembly mounted on the cross member for pivotal movement about an axis paralleling said cross member, said drive motor assembly including a drive motor driving a drive shaft about an axis paralleling said motor assembly pivot axis and having keyed to same a first drive pulley, with said head roller having keyed to same a second drive pulley, a pulley belt in drive transmitting relation between said pulleys, said head pulley axis and said drive shaft axis being in substantially coplanar relation in a plane paralleling said slider bed, said motor assembly pivot axis being disposed below said plane and between said motor assembly and the cross member, and means for spring biasing said motor assembly for movement about its said pivot axis for uniformly tensioning said pulley belt into drive transmitting relation with said pulleys.

7. The improvement set forth in claim 6 wherein:

said drive motor assembly includes handle crank means for pivoting said motor assembly about its said pivot axis in opposition to said biasing means for relieving the tensioning of said pulley belt for relieving same from said drive pulleys.

8. The improvement set forth in claim 7 wherein:

said drive pulleys are respectively of the step up and step down type for manual changing of said drive pulley ratios with respect thereto, on operation of said hand crank means to free said pulley belt of said tensioning by said biasing means.

9. The improvement set forth in claim 6 wherein:

said spring biasing means acts on said motor assembly with substantially constant force.

10. An exercise treadmill belt assembly comprising:

a generally planar slider bed frame having a head end, and a tail end, said frame comprising a slider bed edge mounted between a pair of opposed frame members and having a dry canvased top surfacing extending substantially between said frame ends, a head roller journalled between said frame members at said frame head end, a tail roller journalled between said frame members at said frame tail end, said rollers having elastomeric belt centering crowns, an endless nylon belt trained over said rollers and across said slider bed and defining an upper belt run overlying said slider bed top surface and a lower run passing under said slider bed, means for driving said belt for movement of said belt upper run from said head end to said tail end of said slider bed, said frame having secured to same adjacent said head end thereof and spaced forwardly thereof a cross member extending transversely thereof, a pair of screw members threadedly mounted in said cross member in spaced apart relation and for rotation about upright axes that are in parallelism and that are inclined at like acute angles off perpendicular relationship relative to the plane of said slider bed, said axes each lying in a plane extending normally and longitudinally of said slider bed and being angled relative to the plane of said slider bed to extend forwardly of said slider bed upwardly of said slider bed plane, each of said screw members having a planar soled foot journalled thereon, said slider bed frame having spaced feet adjacent its tail end, said screw members each having threaded portions of substantially equal lengths, and means for simultaneously rotating said screw members in the same direction in forward and reverse directions for threading said cross member longitudinally of said screw member threaded portions to raise and lower said slider bed head end, said feet being proportioned to support said slider bed frame with said slider bed plane horizontally disposed when said screw members are in their retracted positions relative to said cross member with the screw member threaded portions thereof being largely disposed above said cross member, said screw member threaded portions being proportioned in length such that when said screw member threaded portions are in their extended positions relative to said cross member, with said screw member threaded portions thereof being largely disposed below said cross member, said screw members shift relative to the vertical to be disposed substantially vertically and in firm supporting relation to the slider bed with the slider bed disposed at the same said acute angle value with respect to the horizontal so as to be in the maximum grade effect position, said feet of said screw members including means for accommodating rock of said screw member rearwardly and forwardly of said frame when said screw members are operated to shift same between said retracted and extended positions thereof, said screw members in their said retracted positions being at said acute angle relative to the off perpendicular relationship to the plane of said slider bed and said screw members in their said extended positions being substantially vertically disposed, said cross member including a pair of nut assemblies, with one of the screw members being threadedly received in one of said nut assemblies and the other of the screw members being threadedly received in the other of said nut assemblies, said nut assemblies each comprising:

a tubular member of polygonal transverse cross-sectional configuration having a first nut member keyed to the lower end of same and a second nut member keyed to the upper end of same, with the screw member of each nut assembly being threadedly engaged by said nut members thereof, said second nut members being mounted relatively to its tubular member for lost motion longitudinally thereof, said belt driving means comprises:

an electric drive motor assembly mounted on the cross member for pivotal movement about an axis paralleling said cross member, said drive motor assembly including a drive motor driving a drive shaft about an axis paralleling said motor assembly pivot axis and having keyed to same a first drive pulley, with said head roller having keyed to same a second drive pulley operating about an axis paralleling said cross member, a pulley belt in drive transmitting relation between said pulleys, said head pulley axis and said drive shaft axis being in substantially coplanar relation in a plane paralleling said slider bed, said motor assembly pivot axis being disposed below said plane and between said motor assembly and the cross member, and means for spring biasing said motor assembly for movement about its said pivot axis for uniformly tensioning said pulley belt into drive transmitting relation with said pulleys.

11. The improvement set forth in claim 10 wherein:

said drive motor assembly includes handle crank means for pivoting said motor assembly about its said pivot axis in opposition to said biasing means for relieving the tensioning of said pulley belt for relieving same from said drive pulleys.

12. The improvement set forth in claim 11 wherein:

said drive pulleys are respectively of the step up and step down type for manual changing of said drive pulley ratios with respect thereto, on operation of said hand crank means to free said pulley belt of said tensioning by said biasing means.

* * * * *